US008262204B2

(12) United States Patent
Braun et al.

(10) Patent No.: US 8,262,204 B2
(45) Date of Patent: Sep. 11, 2012

(54) PRINT HEAD DIE SLOT RIBS

(75) Inventors: David M. Braun, Corvallis, OR (US); Siddhartha Bhowmik, Salem, OR (US); Swaroop K. Kommera, Corvallis, OR (US); Richard J. Oram, Corvallis, OR (US); Phillip G. Rourke, Corvallis, OR (US); Joshua W. Smith, Corvallis, OR (US); Christopher C. Aschoff, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1354 days.

(21) Appl. No.: 11/872,701

(22) Filed: Oct. 15, 2007

(65) Prior Publication Data

US 2009/0096845 A1 Apr. 16, 2009

(51) Int. Cl.

| | |
|---|---|
| ***B41J 2/175*** | (2006.01) |
| ***B41J 2/16*** | (2006.01) |
| ***B41J 2/05*** | (2006.01) |
| ***B41J 2/045*** | (2006.01) |

(52) U.S. Cl. ..... 347/85; 347/47; 347/65; 347/71; 347/86

(58) Field of Classification Search ..... 347/12, 347/13, 20, 40, 42, 44, 47, 65, 71, 85, 86
See application file for complete search history.

(56) References Cited

U.S. PATENT DOCUMENTS

| | | | | |
|---|---|---|---|---|
| 5,317,346 | A | 5/1994 | Garcia | |
| 5,608,436 | A * | 3/1997 | Baughman et al. | 347/65 |
| 6,350,023 | B1 * | 2/2002 | Silverbrook | 347/85 |
| 6,540,337 | B1 | 4/2003 | Pollard | |
| 6,672,712 | B1 | 1/2004 | Donaldson et al. | |
| 6,830,319 | B2 * | 12/2004 | Harajiri et al. | 347/68 |
| 6,880,246 | B2 | 4/2005 | Horvath et al. | |
| 6,930,055 | B1 | 8/2005 | Bhowmik et al. | |
| 7,040,735 | B2 | 5/2006 | Donaldson et al. | |
| 7,083,268 | B2 | 8/2006 | Obert et al. | |
| 7,437,820 | B2 * | 10/2008 | Sexton et al. | 29/890.1 |
| 2003/0058309 | A1 * | 3/2003 | Haluzak et al. | 347/65 |
| 2004/0017438 | A1 * | 1/2004 | Pollard | 347/65 |
| 2004/0055145 | A1 | 3/2004 | Buswell | |
| 2005/0036004 | A1 * | 2/2005 | Horn et al. | 347/65 |

FOREIGN PATENT DOCUMENTS

EM 0780287 3/1997

OTHER PUBLICATIONS

International Search Report for Application No. PCT/US2008/079943. Report issued Jul. 28, 2009.
Supplementary European Search Report for Application No. EPO8839962.1; Report issued Jan. 31, 2011.

* cited by examiner

*Primary Examiner* — Charlie Peng
*Assistant Examiner* — Hung Lam

(57) ABSTRACT

Methods and an apparatus are disclosed, wherein a print head die includes a slot and ribs across the slot. The ribs are recessed from one or both sides of the die.

22 Claims, 14 Drawing Sheets

PRINT HEAD DIE SLOT RIBS

BACKGROUND

Print head dies support fluid ejection components of a print head and provide a fluid passage from a fluid reservoir to such components. Increasing a density of fluid passages through the die may reduce strength of the die. Current efforts to strengthen the die may reduce print quality.

DETAILED DESCRIPTION OF THE EXAMPLE EMBODIMENTS

Figure 1:
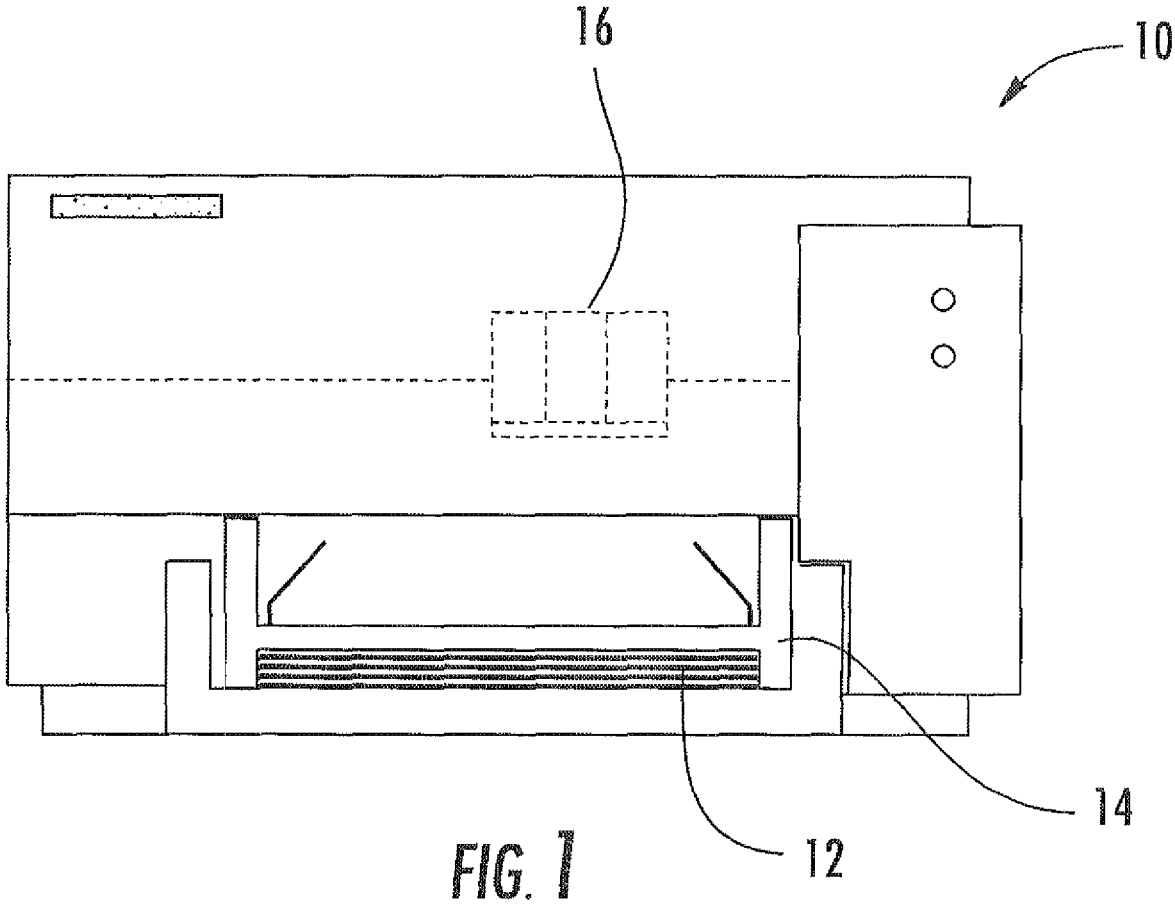
FIG. 1 is a front elevational view of a printer according to an example embodiment.

FIG. 1 illustrates one example of a printing device 10 according to an example embodiment. Printing device 10 is configured to print or deposit ink or other fluid onto a print media 12, such as sheets of paper or other material. Printing device 10 includes a media feed 14 and one or more print cartridges 16. Media feed 14 drives or moves media 12 relative to cartridges 16 which eject ink or fluid onto the medium. In the example illustrated, cartridges 16 are driven or scanned transversely across media 12 during printing. In other embodiment, cartridges 16 maybe stationary and may extend substantially across a transverse width the media 12. As will be described hereinafter, print cartridges 16 include print head dies that have relatively high density of fluid passages, vias or slots while exhibiting enhanced strength and facilitating relatively high print quality.

Figure 2:
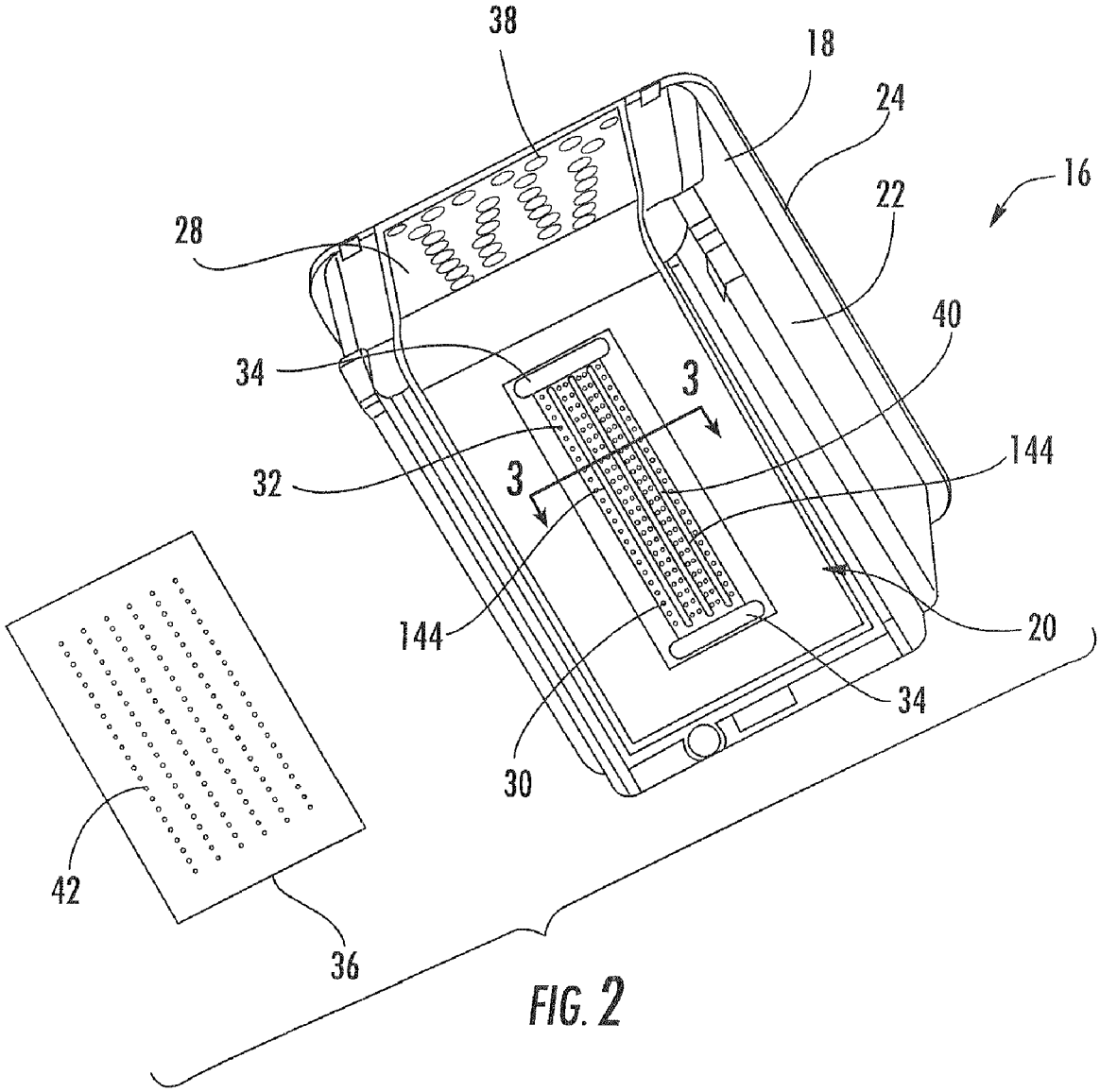
FIG. 2 is an exploded bottom perspective view of a print cartridge of the printer of FIG. 1 according to an example embodiment.

FIG. 2 illustrates one of cartridges 16 in more detail. As shown by FIG. 2, cartridge 16 includes fluid reservoir 18 and head assembly 20. Fluid reservoir 18 comprises one or more structures configured to supply fluid or ink to head assembly 20. In one embodiment, fluid reservoir 18 includes a body 22 and a lid 24 which form one or more internal fluid chambers that contain fluid, such as ink, which is discharged through slots or openings to head assembly 20. In one embodiment, the one or more internal fluid chambers may additionally include a capillary medium (not shown) for exerting a capillary force on the printing fluid to reduce the likelihood of the printing fluid leaking. In one embodiment, each internal chamber of fluid reservoir 18 may further include an internal standpipe (not shown) and a filter across the internal standpipe. In yet another embodiment, fluid reservoir 18 may have other configurations. For example, although fluid reservoir 18 is illustrated as including a self-contained supply of one or more types of fluid or inks, in other embodiments, fluid reservoir 18 may be configured to receive fluid or ink from an off-axis of fluid supply via one or more conduits or tubes.

Head assembly 20 comprises a mechanism coupled to include reservoir 18 by which the fluid or ink is selectively ejected onto a medium. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members.

In the embodiment illustrated, head assembly 20 comprises a drop-on-demand inkjet head assembly. In one embodiment, head assembly 20 comprises a thermoresistive head assembly. In other embodiments, head assembly 20 may comprise other devices configured to selectively deliver or eject printing fluid onto a medium.

In the particular embodiment illustrated, head assembly 20 comprises a tab head assembly (THA) which includes flexible circuit 28, print head die 30, firing resistors 32, encapsulate 34 and orifice plate 36. Flexible circuit 28 comprises a band, panel or other structure of flexible bendable material, such as one or more polymers, supporting or containing electrical lines, wires or traces that terminate at electrical contacts 38 and that are electrically connected to firing circuitry or resistors 32 on die 30. Electrical contacts 38 extend generally orthogonal to die 30 and comprise pads configured to make electrical contact with corresponding electrical contacts of the printing device in which cartridge 16 is employed. As shown by FIG. 2, flexible circuit 28 wraps around body 22 of fluid reservoir 18. In other embodiments, flexible circuit 28 may be omitted or may have other configurations where electrical connection to resistors 32 and their associated addressing or firing circuitry is achieved in other fashions.

Print head die 30 (also known as a print head substrate or chip) comprises one or more structures coupled between the interior fluid chamber of the reservoir 18 and resistors 32. Print head die 30 delivers fluid to resistors 32. In the particular embodiment illustrated, print head die 30 further supports resistors 32. Print head die 30 includes slots 40 and ribs 41 (shown in FIG. 3). The slots 40 comprise fluid passages or fluid via through which fluid is delivered to resistors 32. Slots 40 have a sufficient length to deliver fluid to each of resistors 32 and their associated nozzles. In one embodiment, slots 40 have a width of less than or equal to about 225 micrometers and nominally about 200 micrometers. In the embodiment illustrated in which firing circuitry or resister addressing circuitry is directly provided upon or as part of the chip or die 30, slots 40 have a centerline-to-centerline pitch of approximately 0.8 mm. In embodiments where the firing or addressing circuitry is not provided upon the chip or die 30, slots 40 may have a centerline-to-centerline pitch of approximately 0.5 mm. In other embodiments, slots 40 may have other dimensions and other relative spacings.

Ribs 41 (also known as cross beams) comprise reinforcement structures configured to strengthen and rigidify those portions of print head die 30 between consecutive slots 40 (bars 64). Ribs 41 extend across each of slots 40 generally perpendicular to a major axis along which each of slots 40 extends. In one embodiment, ribs 41 and the center points of ribs 41 are integrally formed as part of the single unitary body with a majority of those portions of print head die 30 on opposite sides of slots 40. As will be described in more detail hereafter, ribs 41 strengthen die 30, permitting slots 40 to be more densely arranged across die 30, without substantially reducing print performance or quality.

Resistors comprise resistive elements or firing circuitry coupled to print head die 30 and configured to generate heat so as to vaporize portions of the printing fluid to forcibly expel drops of printing fluid through orifices in orifice plate 36. In yet other embodiment, the firing circuitry may have other configurations.

Encapsulants 34 comprise one or more material which encapsulate electrical interconnects that interconnect electrically conductive traces or lines associated with die 30 with electrically conductive lines or traces of flexible circuit 28 which are connected to electrical contacts 38. In other embodiments, encapsulates 34 may have other configurations or may be omitted.

Orifice plate 36 comprises a plate or panel having a multitude of orifices which define nozzle openings through which the printing fluid is ejected. Orifice plate 36 is mounted or secured opposite to slots 40 and their associated firing circuitry or resistors 32. In one embodiment, orifice plate 36 comprises a nickel substrate. As shown by FIG. 2, orifice plate 36 includes a plurality of orifices or nozzles 42 through which ink or fluid heated by resistors 32 is ejected for printing on a print medium. In other embodiments, orifice plate 36 may be omitted where such orifices or nozzles are otherwise provided.

Although cartridge 16 is illustrated as a cartridge configured to be removably mounted to or within printer 10, in other embodiments, fluid reservoir 18 may comprise one or more structures which are a substantially permanent part of printer 10 and which are not removable. Although printer 10 is illustrated as a front loading and front discharging desktop printer, in other embodiments, printer 10 may have other configurations and may comprise other printing devices where printer 10 prints or ejects a controlled pattern, image or layout and the like of fluid onto a surface. Examples of other such printing devices include, but are not limited to, facsimile machines, photocopiers, multifunction devices or other devices which print or eject fluid.

Figure 3:
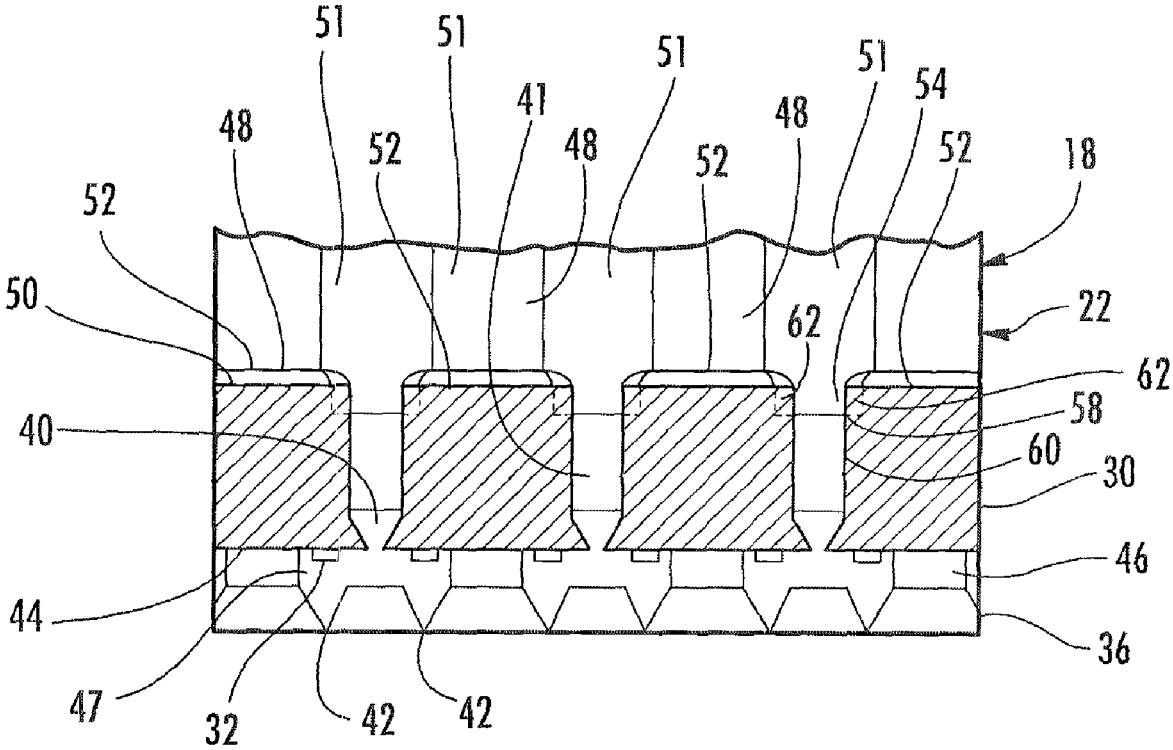
FIG. 3 is a sectional view of the cartridge of FIG. 2 taken along line 3-3 according to an example embodiment.

FIG. 3 is a sectional view illustrating head assembly 20 in detail. In particular, FIG. 3 illustrates print head die 30 coupled between a lower portion of body 22 of reservoir 18 and orifice plate 36. As shown by FIG. 3, in the example illustrated, print head die 30 has a lower or front side 44 joined to orifice plate 36 by a barrier layer 46. Barrier layer 46 at least partially forms firing chambers 47 between resistors 32 and nozzles 42 of orifice plate 36. In one embodiment, barrier layer 46 may comprise a photo-resist polymer substrate. In one embodiment, barrier layer 46 may be formed from the same material as that of orifice plate 36. In yet another embodiment, barrier layer 46 may form orifices or nozzles 42 such that orifice plate 36 may be omitted. In some embodiments, barrier layer 46 may be omitted.

As shown by FIG. 3, resistors 32 are supported on shelves on opposite sides of slots 40 and generally opposite to nozzles 42 within firing chambers 47. Resistors 32 are electrically connected to contact pads 38 (shown in FIG. 2) by electrically conductive lines or traces (not shown) supported by die 30. Electrical energy supplied to resistors 32 vaporizes fluid supply through slots 40 to form a bubble that forces or ejects surrounding or adjacent fluid through nozzles 42. In one embodiment, resistors 32 are further connected to firing or addressing circuitry also located upon die 30. In another embodiment, resistors 32 may be connected to firing or addressing circuitry located elsewhere.

As further shown by FIG. 3, body 22 of reservoir 18 includes inter-posers or headlands 48. Headlands 48 comprise those structures or portions of body 22 which are connected to die 30 so as to fluidly seal one or more chambers of reservoir 18 to a second side 50 of die 30. In the example illustrated, headlands 48 connect each of the three separate fluid containing chambers 51 to each of the three slots 40 of die 30. For example, in one embodiment, reservoir 18 may include three separate stand pipes which deliver fluid to each of the three slots 40. In one embodiment, each of the three separate chambers may include a distinct type of fluid, such as a distinct color of fluid or ink. In other embodiments, body 22 of reservoir 18 may include a greater or fewer number of such headlands 48 depending upon the number of slots 40 in die 30 which are to receive different fluids from different chambers in reservoir 18.

In the example illustrated, side 50 of die 30 is adhesively bonded to body 22 by an adhesive 52. In one embodiment, adhesive 52 comprises a glue or other fluid adhesive. In other embodiments, headlands 48 of reservoir 18 may be sealed and joined to die 30 in other fashions.

Figure 4:
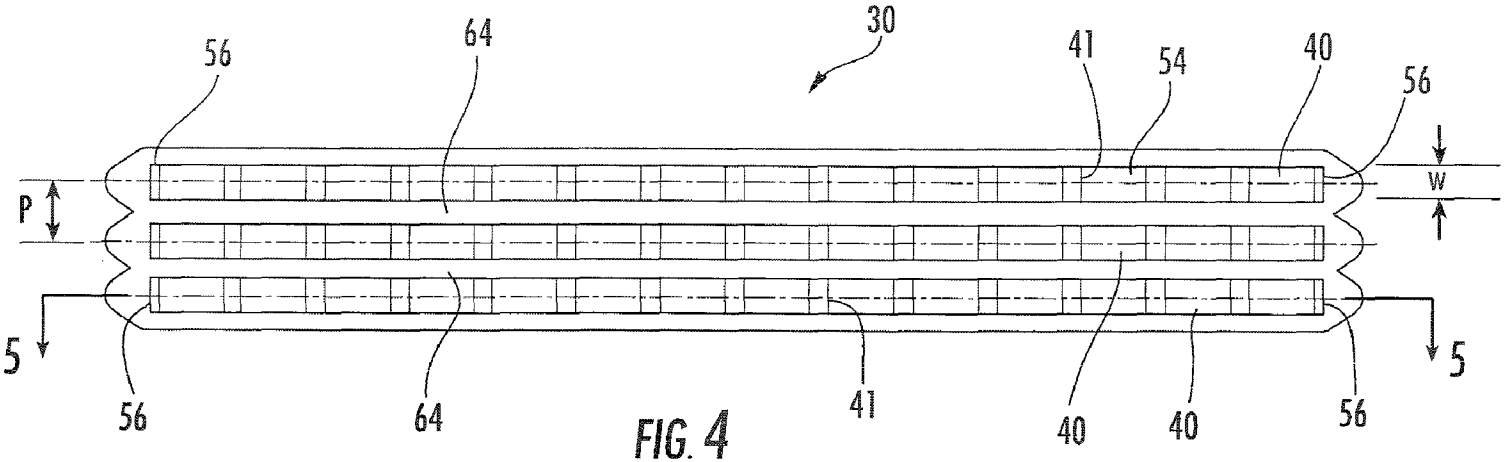
FIG. 4 is a top plan of view of a print head die of the print cartridge of FIG. 2 according to an example embodiment.
Figure 5:
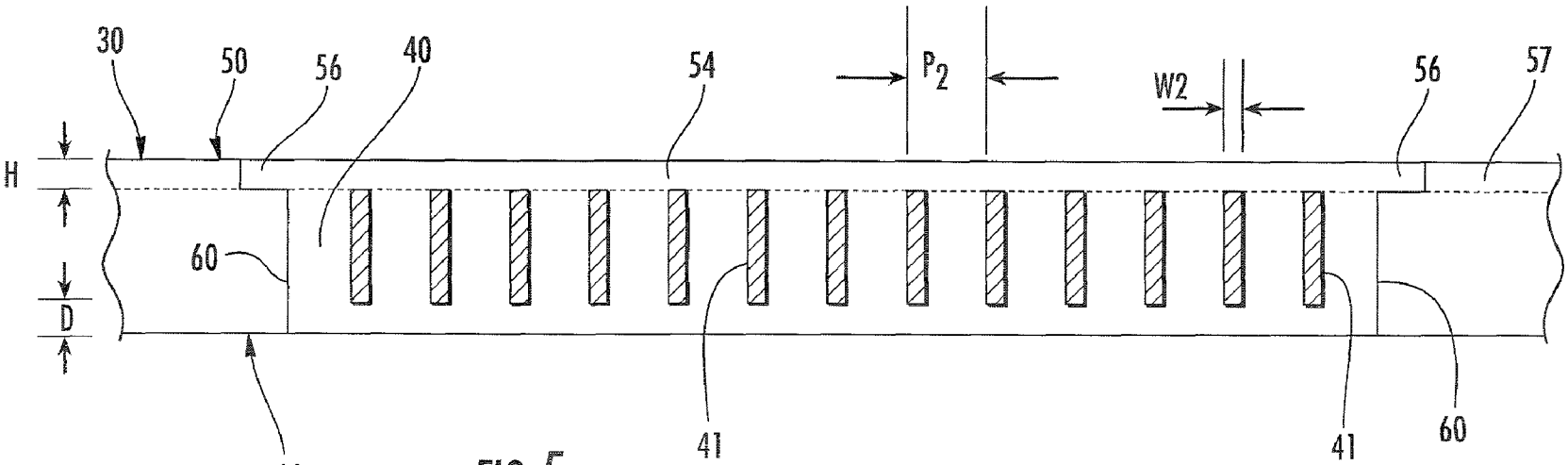
FIG. 5 is a sectional view of the print head die of FIG. 4 taken along the line 5-5 according to an example embodiment.

FIGS. 4-5 illustrate slots 40 and ribs 60 of print head die 30 in detail. FIG. 4 is a plan view of print head die 30 taken from side 50. FIG. 5 is a sectional view through print head die 38 along a line 5-5 of FIG. 4. As shown by FIG. 5, portions 54 of die 30 adjacent to side 50 are counter sunk or recessed above each of ribs 41 and axially along each slot 40. As a result, each of ribs 41 is also recessed or countersunk from an outermost side or topside 50 of die 30. In addition, portions 56 adjacent to side 50 and located at axial ends of each of slots 40 are counter sunk or recessed. As will be described hereafter, the countersunk or recessed portions 54 and 56 may be formed by either one or more material removal techniques or processes wherein material is removed to form portions 54, 56 or by one or more material additive techniques or processes wherein one or more layers of one or more materials are added adjacent to portions 54 and 56 such that portions 54 and 56 are recessed relative to the surface of the topmost added layer. For example, as indicated by broken lines in FIG. 5, countersunk portions 54 and 56 are surrounded by elevated portions 57 which extend above ribs 41 and which project above side 60 of slots 40. Such elevated portions 57 may be formed by adding material to die 30 or by removing material from die 30.

Because die 30 includes recessed or countersunk regions or portions 54, 56 along each of slots 40 (and above ribs 41) and at axial ends of slots 40, the adhesive material 52 (shown in FIG. 3) that is applied while in a fluid or viscous state to join head lands 48 to print head die 30 is less likely to wick or otherwise flow into slots 40. In particular, recessed portions 54, 56 reduce the number and area of corners 58 along face or side 50 and along slots 40. Instead, such corners 58 between ribs 41 and adjacent sides 60 of slots 40 are recessed and do not extend adjacent to or coplaner with side 50. The recessed or countersunk portions form a "capillary break" which keeps flowing adhesive from reaching the ink feed holes or slots 40. As a result, the adhesive material 52 is less likely to flow into slots 40. Thus, slots 40 are less likely to become clogged or partially blocked by adhesive extending along the sides 60 of slots 40 and projecting into the fluid passages provided by slots 40. Consequently, print head die 30 provides enhanced fluid or ink flow for enhanced print quality.

According to one embodiment, countersunk portions 54, 56 have a depth or height H (shown in FIG. 5) of between about 10μ (microns or micrometers) and about 50μ and nominally about 15 micrometers. Although it has been found that such heights reduce wicking of adhesive material 52, in other embodiments, countersunk portions 54, 56 may have other heights H. In yet another embodiment, countersunk portions 54, 56 may be employed independent of one another. For example, in one embodiment, countersunk portions 56 may be omitted. In other embodiments, countersunk portions 54 may be omitted while still providing some of the noted benefits. Although countersunk portions 54 and 56 are illustrated as both having the same height H, in other embodiments, countersunk portions 54 and 56 may have different heights H or depths from side 50.

As indicated in broken lines in FIG. 3, in yet another embodiment, die 30 may additionally include countersunk portions 62. Countersunk portions 62 comprise recesses or gaps which axially extend along slots 40 adjacent to side 50 along transverse sides of slots 40. Countersunk portions 62 comprise notches extending axially along transverse sides 60 of slots 40. As with countersunk portions 54 and 56, countersunk portions 62 may be formed by either material removal processes or techniques or material additive processes or techniques. Although countersunk portions 62 are illustrated as extending adjacent to and having substantially the same height H as countersunk portions 54, in other embodiments, countersunk portions 62 may have different heights H or depths from side 50. Although countersunk portions 62 are illustrated as extending adjacent to opposite transverse sides of ribs 41 and countersunk portions 54, in other embodiments, countersunk portions 62 may extend along one and not both transverse sides of ribs 41 and countersunk portions 54.

As further shown by FIG. 5, ribs 41 are recessed from side 44 of die 30. According to one embodiment, ribs 41 are recessed or spaced from side 44 by a distance D have at least 100 micrometers and nominally about 175 micrometers. Because ribs 41 are recessed from side 44 by at least 100 micrometers, print quality is enhanced. In particular, the material of ribs 41 is sometimes heated from the heat generated by resisters 32 (shown in FIG. 3). The heated ribs transfer heat to the adjacent ink or fluid which affects the vapor pressure and bubble characteristics of the fluid or ink. This in turn may reduce or otherwise change the size or drop weight of the fluid drop ejected during each firing. As a result, the image printed may experience dark printed bands opposite to the ribs. However, because ribs 41 are recessed or spaced from side 44 by a distance D of at least about 100 micrometers, ribs 41 are more greatly spaced from surface 44, resisters 32 and nozzles 42. As a result, even the reduced amount of heat transferred to the fluid or ink by the ribs is permitted to spread out across the print head, lessening temperature variations between ink or fluid that is directly opposite to the ribs 61 and ink or fluid that is directly opposite to areas between consecutive ribs. By reducing temperature variations, drop weight variations are also reduced, producing a more uniform higher-quality print result.

To further enhance print quality while maintaining the strength of print die 30 (the rigidity of bars 64 between consecutive slots 40), ribs 41 have a relatively small width and a relatively small pitch. According to one embodiment, ribs 41 have a width W2 of between about 50 micrometers and about 100 micrometers. Ribs 41 have a center-to-center pitch P2 of between about 200μ and about 500μ and nominally about 350 micrometers. By providing ribs 41 with a relatively small width and relatively small pitch, transfer of heat to fluid or ink across the area of die 30 is more uniform further reducing the likelihood of banding in the printed image. At the same time, the width of ribs 41 is sufficient to adequately rigidify and strengthen bars 64. The pitch of ribs 41 is sufficiently large and the width of ribs 41 is sufficiently narrow to reduce the likelihood of bubble entrapment and fluid flow occlusion.

According to one embodiment, die 30 has a thickness of about 500 micrometers. Slots 40 have a width W of about 200 micrometers and a pitch of about 0.8 mm. Likewise, ribs 41 have a length of about 200μ. Ribs 41 have a width W2 of between about 50 micrometers and about 100 micrometers and a pitch of about 350 micrometers. Ribs 41 have a height of between about 450 micrometers and 490 micrometers. Ribs 41 are recessed from face or side 50 by between 10 micrometers and 50 micrometers and are spaced or recessed from side 44 by 175 micrometers. In such an embodiment, die 30 is formed from silicon. In other embodiments, die 30 may have other feature dimensions and may be formed from other materials.

Figure 6:
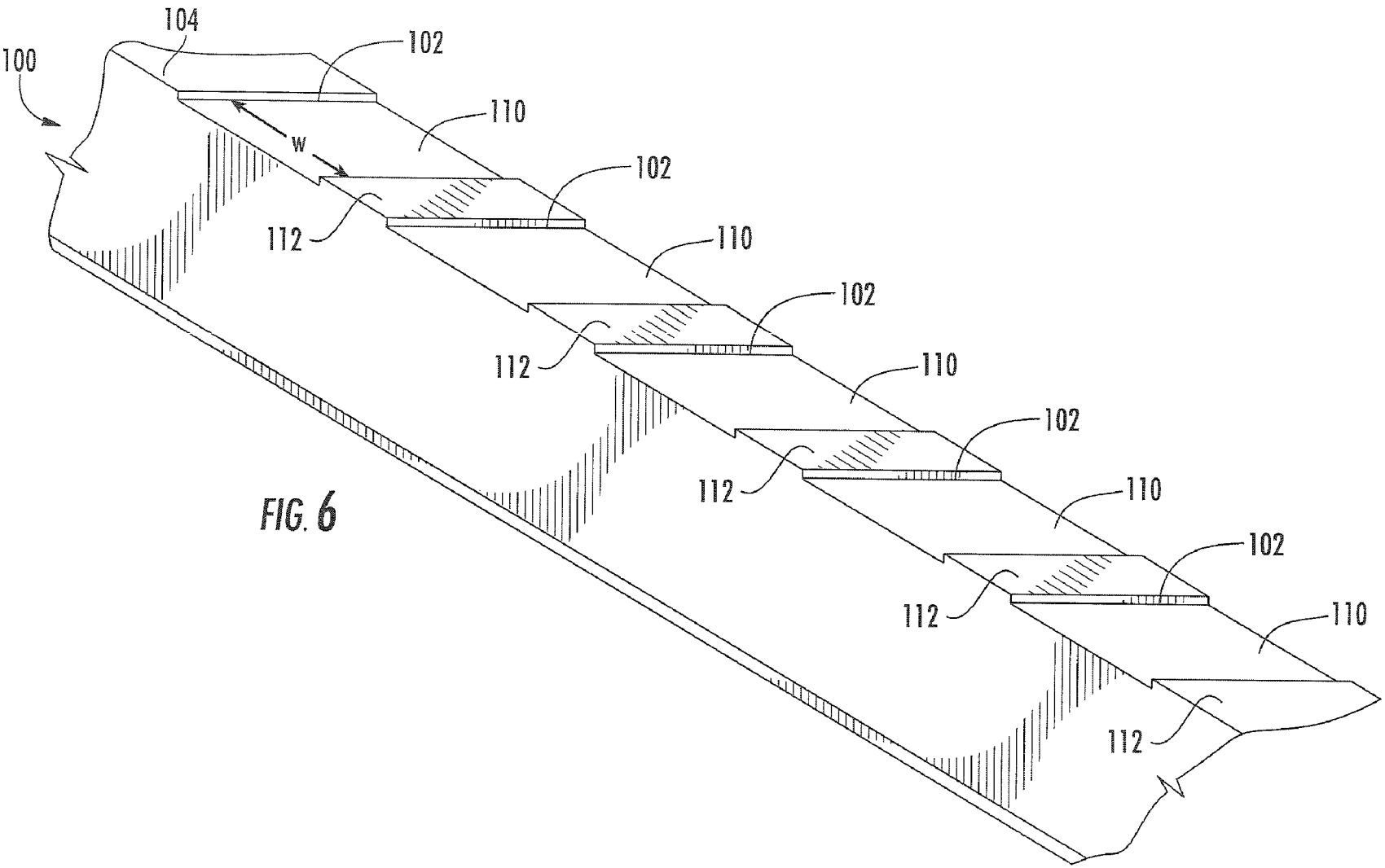
FIGS. 6-10 are fragmentary top perspective views illustrating a method for forming the print head die of FIG. 4 according to an example embodiment.

FIGS. 6-10 illustrates one example process flow or method 100 for forming slots 40 and ribs 41 of die 30. As shown in FIG. 6, a trough 102 is formed in substrate 104. Trough 102 substantially corresponds to the width W of slot 40 (shown in FIG. 4). According to one embodiment, trough 102 has a width W of about 200 micrometers. In other embodiments, trough 102 may have other dimensions. The axial length of trough 102 extends the full length of the desired length of slots 40 as well as the axial length of countersunk portions 56 at the ends of slots 40 (shown in FIG. 4). In other words, trough 102 extends past where the last via or end portion of slot 40 will reside. Trough 102 has a depth of between about 10 micrometers and about 100 micrometers. According to one embodiment, trough 102 may be formed by laser ablating followed by a wet etch, such as a tetramethylammonium hydroxide (TMAH) wet etch, to remove a laser debris. In other embodiments, trough 102 may be formed in other fashions.

Figure 7:
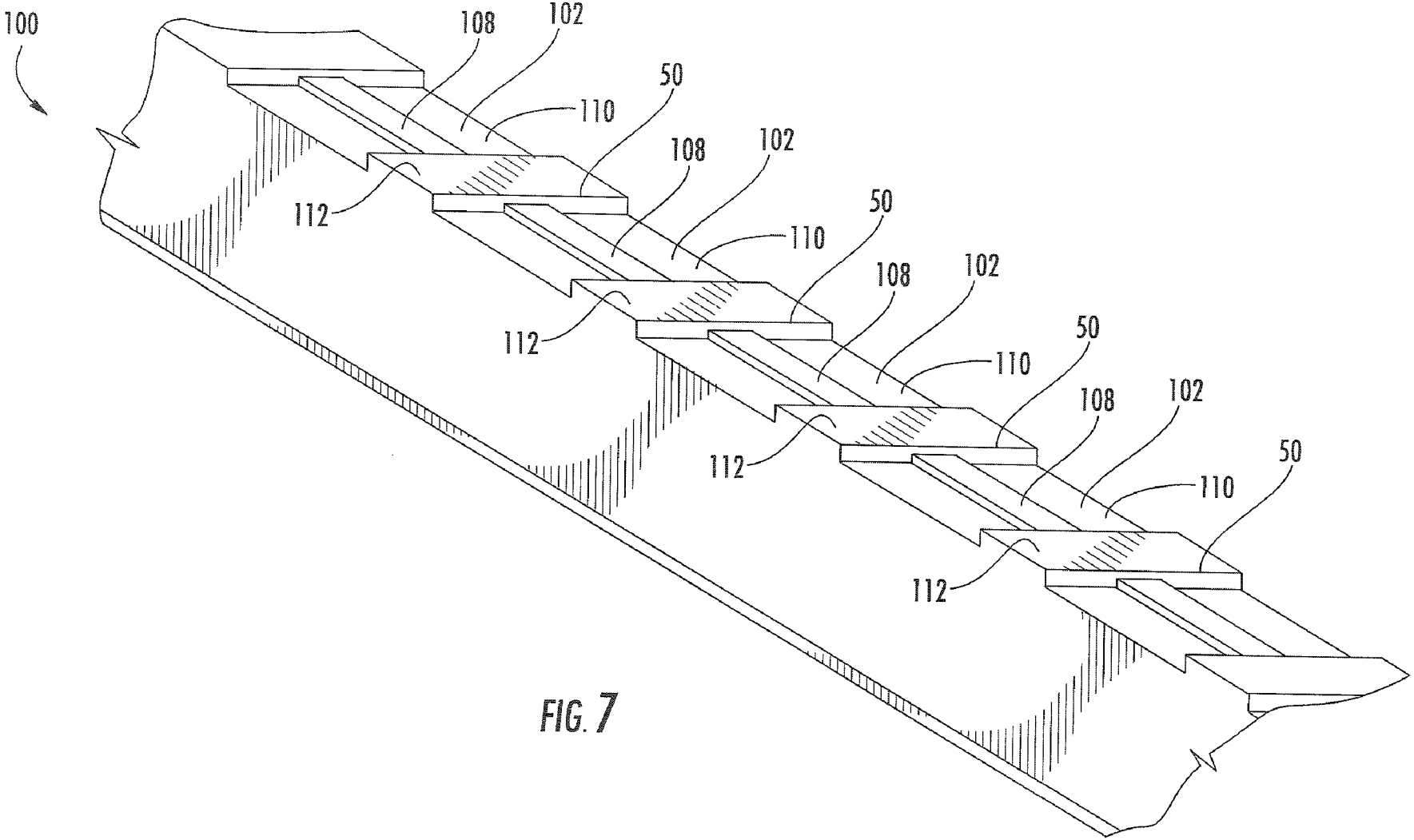

As shown by FIG. 7, a hard mask 108 for the subsequent formation of ribs 41 is formed. Hard mask 108 has a length and a width corresponding to the length and the width of the ribs 41 to be formed (shown in FIGS. 4 and 5). Thus, in one embodiment, hard mask 108 has a length of approximately 200 micrometers and a width of between about 50 micrometers and 100 micrometers. In other embodiments, hard mask 108 may have other dimensions.

According to one embodiment, hard mask 108 is formed by depositing one or more materials on the floor 110 of trough 102 that are laser ablatable yet resistant to the dry etchant to be used to remove portions of substrate 104 to deepen trough 102 about hard mask 108. According to one embodiment, hard mask 108 is formed by depositing layers of approximately 600 Å of Ti and 6000 Å of AlCu or Al. The deposited layers are laser ablated or laser patterned down to or through 110 of trough 102, leaving hard mask 108 which bridges or spans across trough 102 between elevated portions 112 of substrate 104, and also remains on 112. In other embodiments, hard mask 108 may be formed from other materials, may have other dimensions and may be formed in other fashions.

Figure 8:
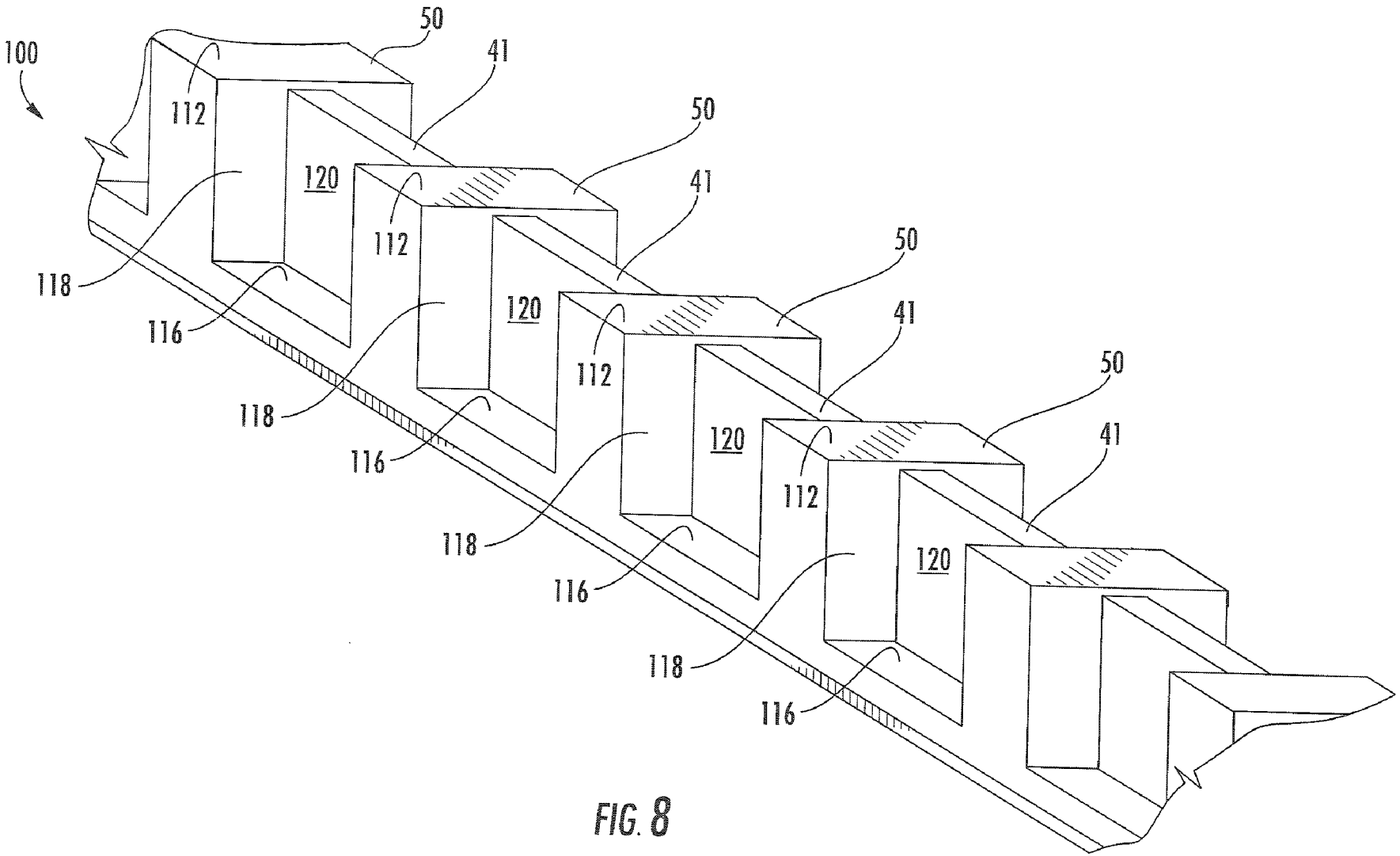

As shown in FIG. 8, additional material or portions of substrate 104 on opposite sides of hard mask 108 is removed to deepen trough 102, which is blind or which is configured like a bathtub having a floor 116, sides 118 and end surfaces 120 (the sides of ribs 41). As further shown by FIG. 8, hard mask 108 is also removed after trough 102 has been deepened. According to one embodiment, a dry etchant, such as $SF_6$ and $C_4F_8$, is applied to etch those portions of substrate 104 below floor 110 and not protected by hard mask 108. The dry etching process is controlled so as to not extend completely through substrate 104 and so as to form floor 116. Thereafter, a wet etchant, such as $NH_4OH$, $H_2O_2$, and $H_2O$, is applied to remove hard mask 108. In other embodiments, the hard mask 108 may be left. In other embodiments, trough 102 may be deepened using other material removal processes. As shown by FIG. 8, the resulting structure forms rib 41 which is recessed from side 50 of substrate 104. According to one embodiment, rib 41 is recessed from side 50 by between about 10 micrometers and about 50 micrometers.

Figure 9:
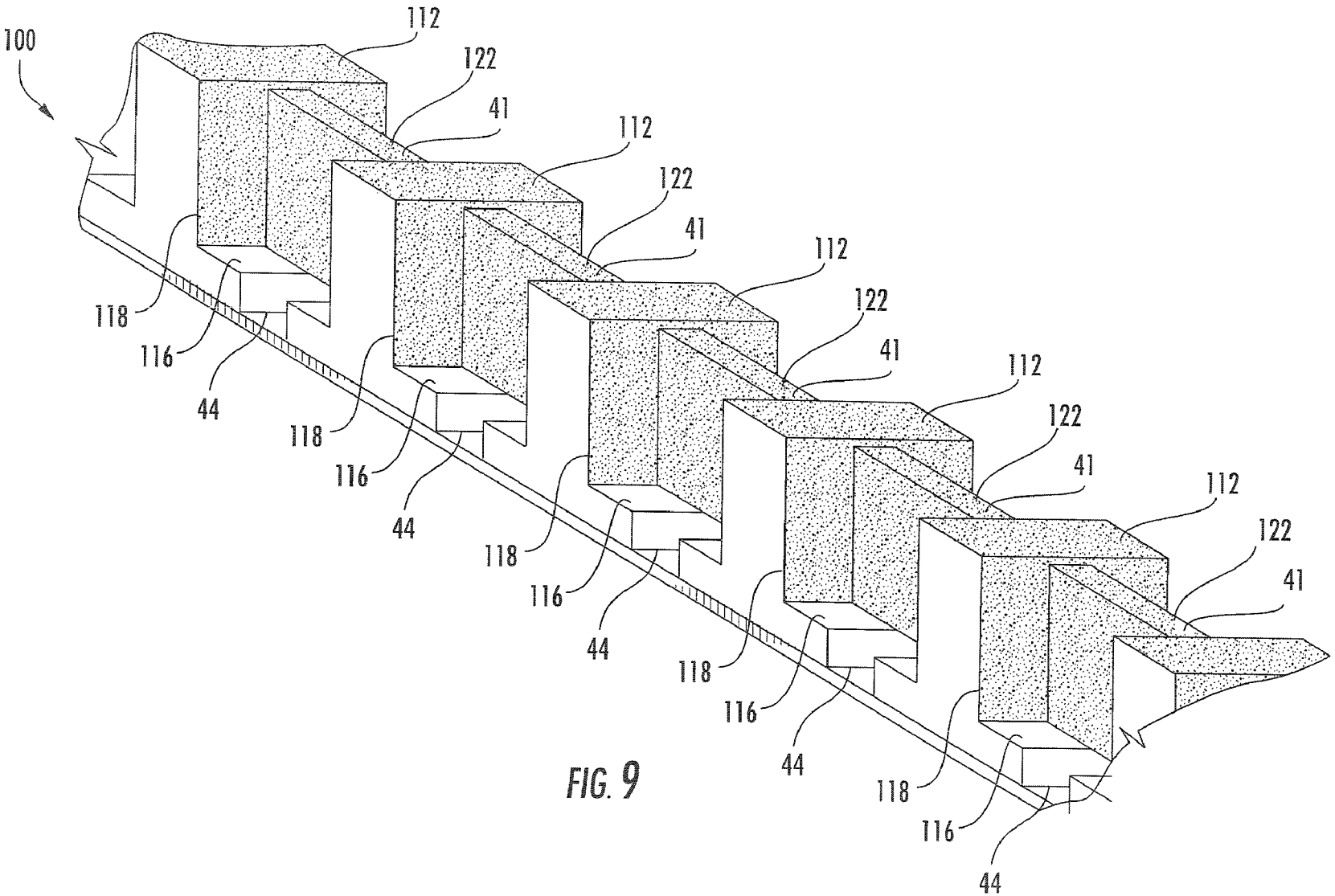
Figure 10:
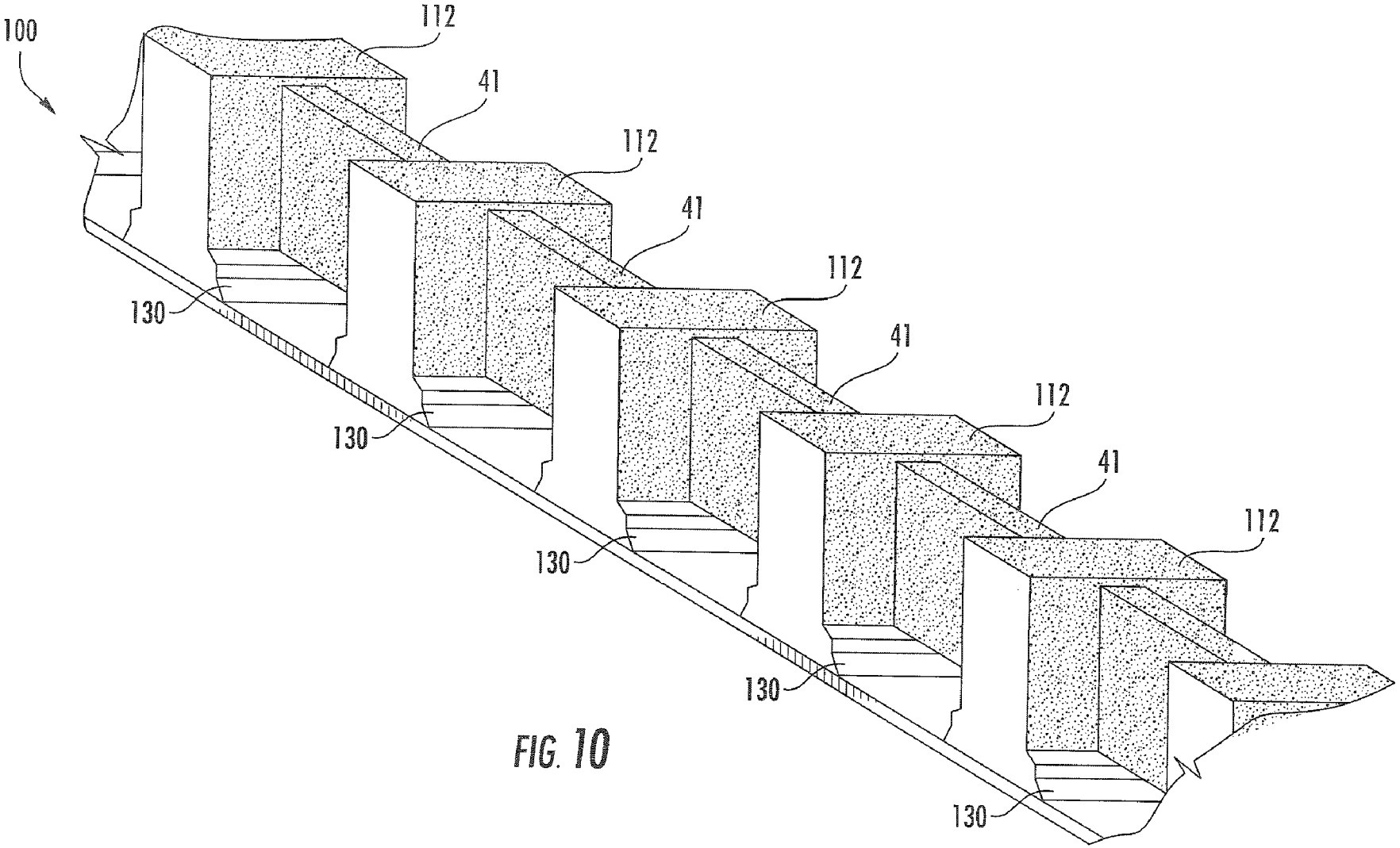

FIGS. 9 and 10 illustrates completion of slot 40 by further removing additional material from the floor 116 to form a fluid passage through substrate 104. The process shown in FIGS. 9 and 10 also results in rib 41 being recessed or spaced from side 44 of substrate 104 (which ultimately forms die 30). As shown my FIG. 9, dielectric mask layers or a single dielectric mask layer 122 is formed on ribs 41. In the example illustrated, the dielectric mask layer 122 that is laser ablatable is formed or deposited across a top and sides of rib 41, on floor 116, on sides 118 and on elevated portion 112 of substrate 104. Thereafter, portions of the dielectric mask layer are removed from floor 116 and a dry etch resistant laser ablatable layer or layers is formed upon floor 116. Portions of the dry etch resistant laser ablatable layer are subsequently removed to define those additional underlying areas of substrate 104 that will be removed to further deepen trough 102 to complete slot 40. The remaining portions of substrate 104 along floor 116 which are not protected by the dry etch resistant laser ablatable layer are removed to form the lower fluid via 130 and to complete slot 40.

According to one embodiment, the dielectric mask layer 122 is formed by depositing 1 micrometer to 2 micrometers of tetraethyl orthosilicate (TEOS) across a top and sides of rib 41, on floor 116, on sides 118 and on elevated portion 112 of substrate 104. In other embodiments, other materials may be used in place of TEOS such as atomic layer deposition Hafnium Oxide, SiN, SiC, Ta or combinations such as a layer of ALD $HfO_2$ with and additional layer of TEOS. Those portions of layer 122 which reside upon floor 116 of substrate 104 are removed using laser ablation. A wet etch is further applied to remove laser debris. Thereafter, a layer of AlCu or Al having thickness of approximately 1 micrometer is deposited upon floor 116. Those portions of the layer of AlCu or Al corresponding to the underlying fluid via 130 (shown in FIG. 10) are removed through laser ablation or laser patterning. In one embodiment, a 60 micrometers to 90 micrometers wide region of the layer of AlCu or Al is removed from floor 116 of substrate 104. A dry etchant, such as $SF_6$ and $C_4F_8$ is subsequently applied to etch through floor 116 and through substrate 104. As shown in FIG. 10, the AlCu or Al is removed in a wet etchant, such as $NH_4OH$, $H_2O_2$, and $H_2O$, and a wet etchant, such as TMAH, is also applied to widen and complete the lower via 130 of slot 40. As a result, rib 41 is spaced from surface 44 by the distance D shown in FIG. 5. In other embodiments, slot 40 may be completed using other material removal steps or processes. For example, other masking materials and removal chemistries may be used.

The above described method 100 facilitates the formation of a print head die 30 (shown and described with respect to FIGS. 3-5) which has relatively narrow slot widths, a relatively small slot pitch, relatively thin ribs having a relatively small pitch and which are recessed from opposite faces of the die. Method 100 facilitates the fabrication of print head die 30 with fewer and less expensive fabrication steps, reducing cost and complexity.

Figure 11:
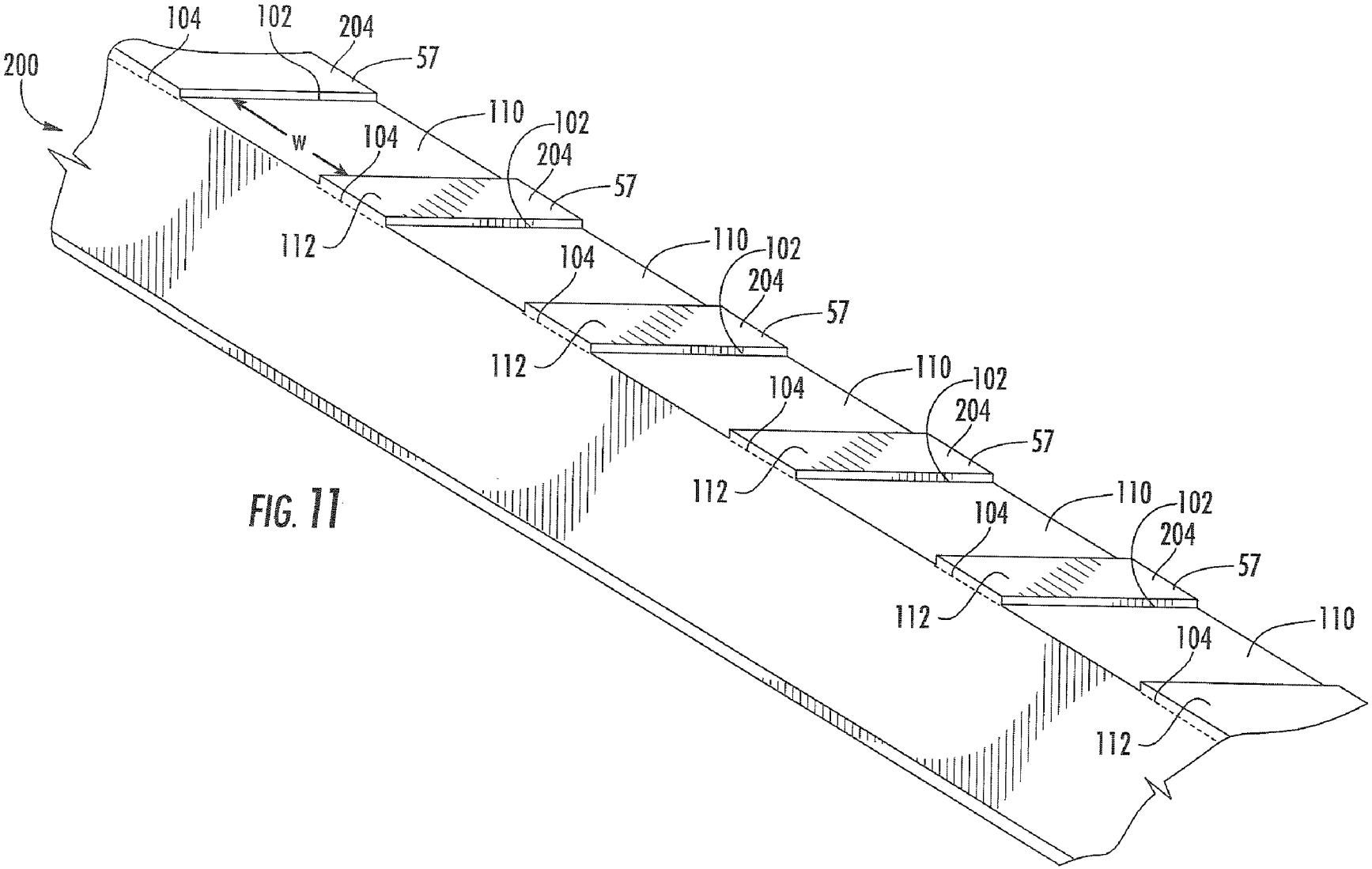
FIGS. 11-15 are fragmentary top perspective views illustrating another method for forming the print head die of FIG. 4 according to an example embodiment.
Figure 12:
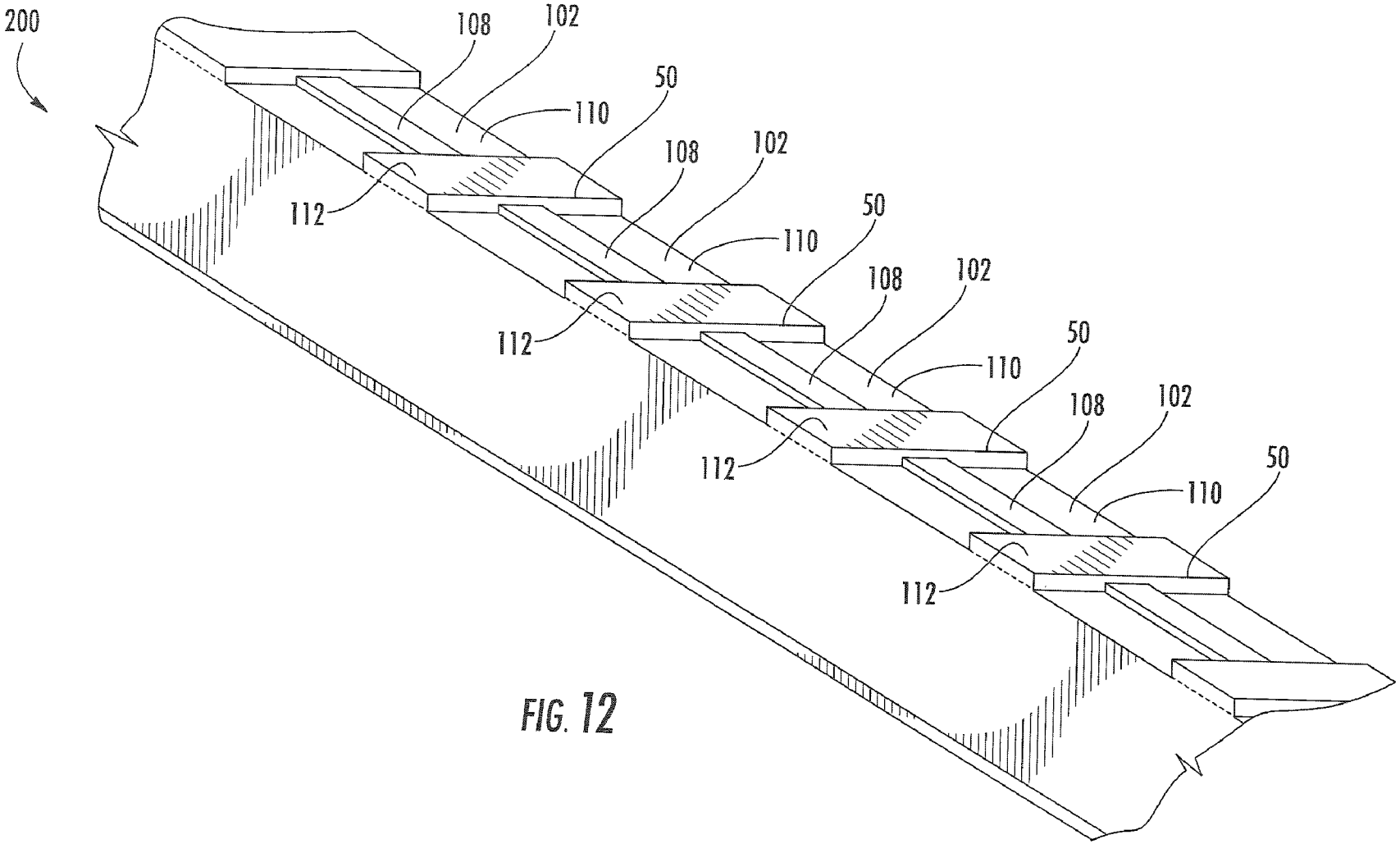
Figure 13:
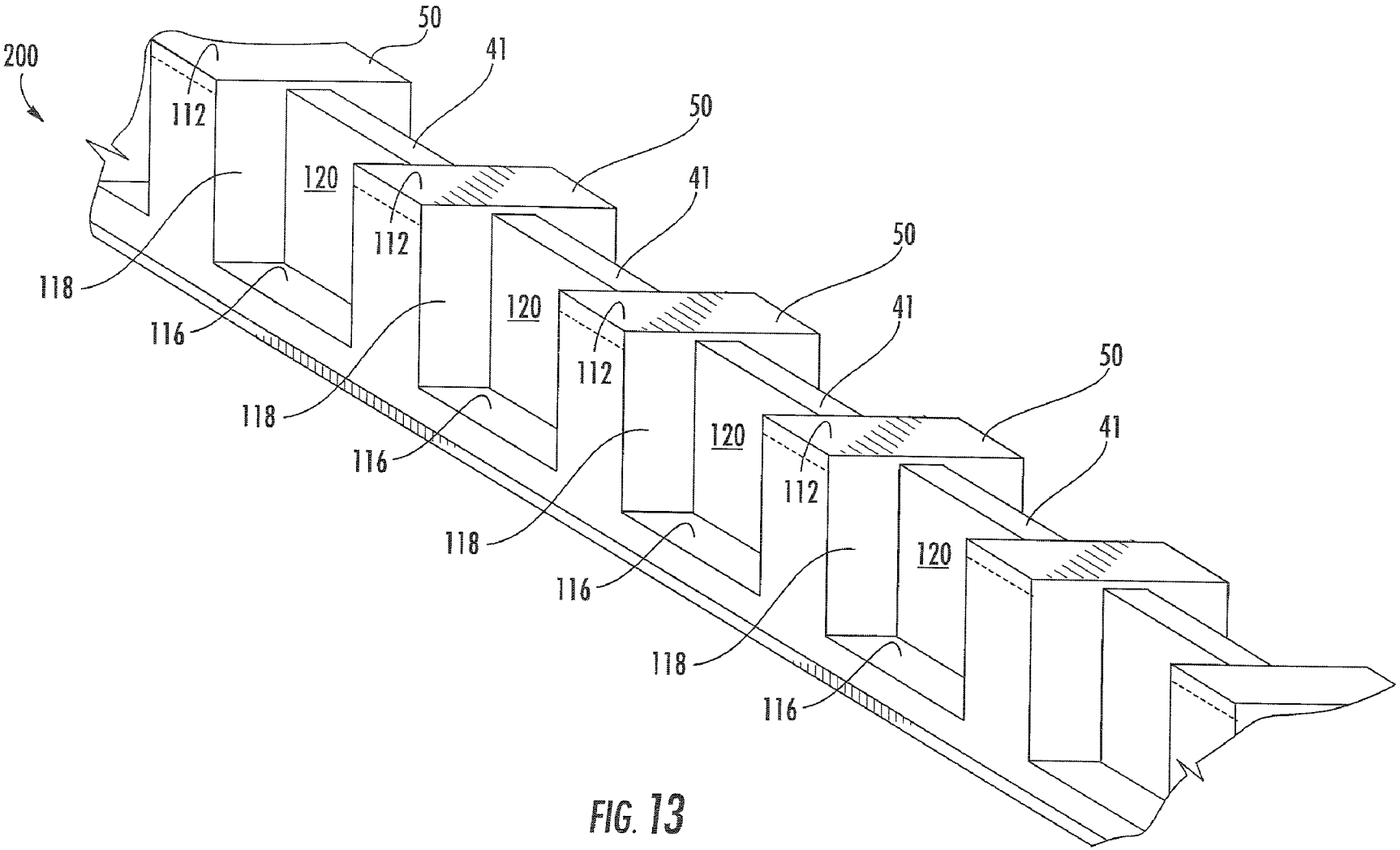
Figure 14:
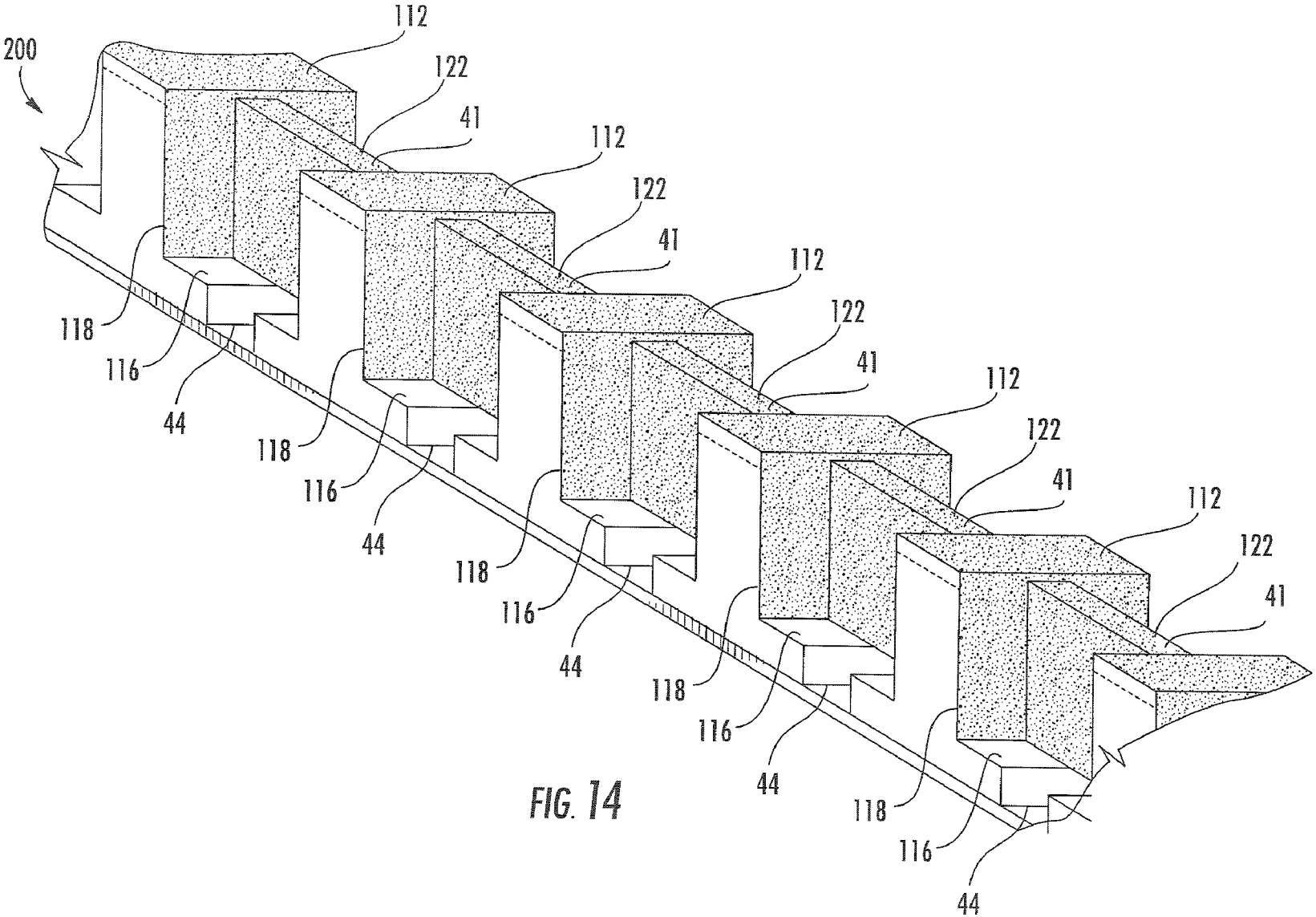
Figure 15:
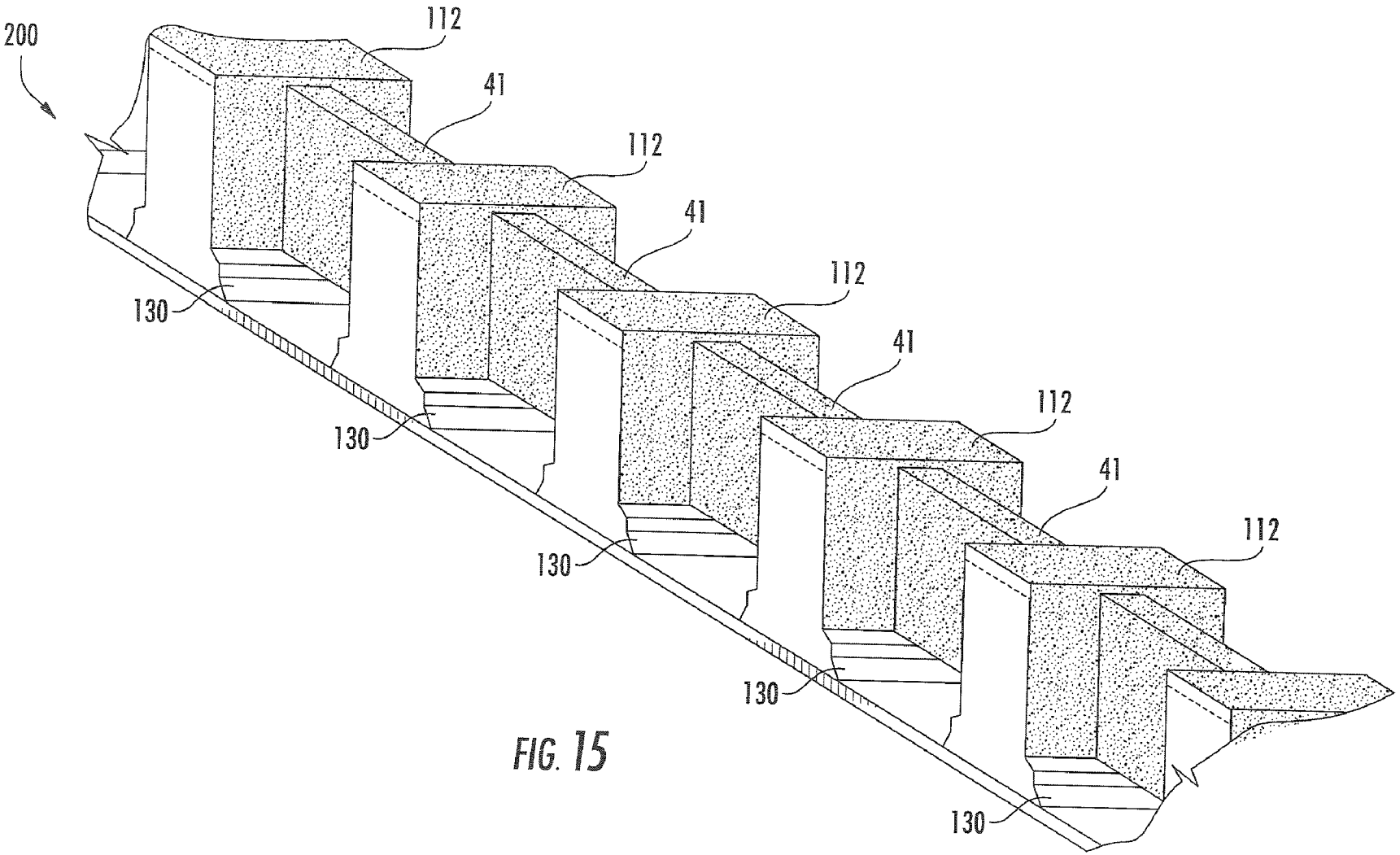

FIGS. 11-15 illustrate method 200, another method for forming print head die 30. In particular, FIGS. 11-15 illustrate method 200 wherein elevated portion 57 of print head die 30 (shown in FIG. 5) is formed by material additive processes rather than by material subtraction or removal processes. FIGS. 11-15 illustrate processes corresponding to the processes shown in the FIGS. 6-10, respectively. However, in contrast to method 100, method 200 forms elevated portion 57 by adding material. For example, elevated portion 57 may comprise one or more layers added onto the substrate. As shown in FIG. 11-15, the additional layers may be added to substrate 104 to form elevated portion 57 at any one or a multitude of various stages during the formation of die 30. For example, as shown in FIG. 11, one or more layers 204 may be added at spaced intervals along the substrate 104 to form trough 102. For example, one or more layers 204 may be added using various masking and photolithographic techniques. Alternatively, as shown by FIGS. 12-15, elevated portion 57 may be added at other points during the formation of slots 40 and ribs 41. In particular embodiments where elevated portion 57 includes multiple layers, such multiple layers may be added at distinct times during the making of die 30.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a print head die having a first side configured to face a fluid reservoir and a second opposite side opposite the first side, the die comprising:

a fluid feed slot through the die; and ribs extending across the slot, wherein the ribs are recessed from the first side and the second side of the die, wherein the slot is between and bordered by two opposing side surfaces, wherein each of the ribs has a top surface and a bottom surface, the top surface being spaced below a top of the two opposing side surfaces and the bottom surface being spaced above a bottom of the two opposing side surfaces.

2. The apparatus of claim 1, wherein the die includes countersunk portions at opposite axial ends of the slot.

3. The apparatus of claim 1, wherein the die includes elevated portions elevated above the ribs at ends of the ribs and wherein the elevated portions are integrally formed as part of a single unitary body with a center point portion of each rib.

4. The apparatus of claim 1, wherein the die comprises:

a main portion at ends of the ribs integrally formed as a single unitary body with a center point portion of the ribs; and one or more layers on the main portion and forming elevated portions elevated above the ribs at ends of the ribs.

5. The apparatus of claim 4, wherein the main portion has a surface substantially level with a surface of the rib.

6. The apparatus of claim 1 further comprising a layer of tetraethyl orthosilicate (TEOS) over the ribs.

7. The apparatus of claim 1, wherein the ribs are recessed from the first side by least about 100μ.

8. The apparatus of claim 1 further comprising a fluid reservoir adhesively bonded to the die on the first side of the die.

9. The apparatus of claim 8 further comprising an orifice plate coupled to the die on a second opposite side of the die.

10. The apparatus of claim 1, wherein the ribs have a center-to-center pitch of less than or equal to about 500μ.

11. The apparatus of claim 1, wherein each rib has a width of less or equal to about 100μ.

12. The apparatus of claim 1, wherein the die includes first countersunk portions on the first side of the die and extending along transverse sides of the slot.

13. A method comprising:

forming a slot in a die, wherein forming the slot comprises etching through the die to form the slot;

forming ribs across the slot, wherein the ribs are recessed from at least one side of the die, wherein the slot is between and bordered by two opposing side surfaces, wherein each of the ribs has a top surface and a bottom surface, the top surface being spaced below a top of the two opposing side surfaces and the bottom surface being spaced above a bottom of the two opposing side surfaces; and forming a dielectric mask layer on the ribs.

14. The method of claim 13 comprising recessing the ribs from a first side of the slot that is configured to be coupled to a fluid reservoir.

15. The method of claim 14, wherein the recessing of the ribs includes removing material from the first side of the die above the ribs to recess the ribs.

16. The method of claim 13, wherein forming the slot and forming the ribs comprises:

forming a trough in a first side of the die;

forming a laser ablatable layer on the trough;

laser ablating a first portion of the laser ablatable layer, wherein second portions of the laser ablatable layer mask the ribs; and etching the substrate partially through the die to form a floor.

17. The apparatus of claim 12, wherein each of the ribs has a top surface recessed from the first side of the die and wherein the first countersunk portions have a surface level with the top surface of the ribs.

18. The apparatus of claim 12, wherein the die includes second countersunk portions at opposite axial ends of the slot.

19. An apparatus comprising:

a print head die having a first side configured to face a fluid reservoir and a second opposite side, the die comprising:

a fluid feed slot through the die;

ribs extending across the slot, wherein the ribs are recessed from the second side of the die, wherein the slot is between and bordered by two opposing side surfaces, wherein each of the ribs has a top surface and a bottom surface, the top surface being spaced below a top of the two opposing side surfaces and the bottom surface being spaced above a bottom of the two opposing side surfaces; and countersunk portions on the first side of the die and extending along transverse sides of the slot.

20. The apparatus of claim 1 further comprising:

a first resistor carried on the second side of the print head die, the first resistor being located on a first side of the fluid feed slot; and a second resistor carried on the second side of the print head die, the second resistor being located on a second side of the fluid feed slot.

21. The apparatus of claim 1, wherein the fluid feed slot narrows between the ribs and the second side.

22. A method comprising:

forming a slot in a die, wherein forming the slot comprises etching through the die to form the slot;

forming ribs across the slot, wherein the ribs are recessed from at least one side of the die; and forming a dielectric mask layer on the ribs, wherein forming the slot and forming the ribs comprises:

forming a trough in a first side of the die;

forming a laser ablatable layer on the trough;

laser ablating a first portion of the laser ablatable layer, wherein second portions of the laser ablatable layer mask the ribs; and etching the substrate partially through the die to form a floor.

* * * * *

UNITED STATES PATENT AND TRADEMARK OFFICE

CERTIFICATE OF CORRECTION

PATENT NO. : 8,262,204 B2
APPLICATION NO. : 11/872701
DATED : September 11, 2012
INVENTOR(S) : David M. Braun et al.

It is certified that error appears in the above-identified patent and that said Letters Patent is hereby corrected as shown below:

In column 9, line 4, in Claim 7, after "by" insert -- at --.

Signed and Sealed this
Twelfth Day of February, 2013

Teresa Stanek Rea
*Acting Director of the United States Patent and Trademark Office*